US008286817B2

(12) United States Patent
Wilson et al.

(10) Patent No.: US 8,286,817 B2
(45) Date of Patent: Oct. 16, 2012

(54) TAMPER RESISTANT CONTAINER WITH LOCKING RIM

(75) Inventors: Tracie Lynn Wilson, Westminster, MD (US); Steve Gift, Litiz, PA (US); Tom Coulter, Baltimore, MD (US); Duane Sawyer, York, PA (US)

(73) Assignee: McCormick & Company, Incorporated, Sparks, MD (US)

( * ) Notice: Subject to any disclaimer, the term of this patent is extended or adjusted under 35 U.S.C. 154(b) by 728 days.

(21) Appl. No.: 12/254,576

(22) Filed: Oct. 20, 2008

(65) Prior Publication Data

US 2009/0101645 A1 Apr. 23, 2009

Related U.S. Application Data

(60) Provisional application No. 60/981,069, filed on Oct. 18, 2007.

(51) Int. Cl.

| | |
|---|---|
| ***B65D 51/18*** | (2006.01) |
| ***B65D 51/04*** | (2006.01) |
| ***B65D 41/32*** | (2006.01) |
| ***B65D 43/24*** | (2006.01) |

(52) U.S. Cl. ..... 220/254.2; 220/254.3; 220/254.4; 220/254.5; 220/266; 220/270; 220/831; 222/480

(58) Field of Classification Search ..... 220/254.2, 220/254.3, 254.4, 254.5, 266, 270, 831; 222/480, 222/556; 53/478, 485

See application file for complete search history.

(56) References Cited

U.S. PATENT DOCUMENTS

| | | | |
|---|---|---|---|
| 611,410 | A | 9/1898 | Holland |
| 844,640 | A | 2/1907 | West |
| 961,991 | A | 6/1910 | Ullrich |
| 1,077,459 | A | 11/1913 | Driscoll |
| 1,134,427 | A | 4/1915 | Ullrich |
| 1,141,535 | A | 6/1915 | Freundt |
| 1,153,356 | A | 9/1915 | Truesbury |
| 1,184,549 | A | 5/1916 | McClung |

(Continued)

FOREIGN PATENT DOCUMENTS

| | | | |
|---|---|---|---|
| CN | 2511622 | Y | 9/2002 |

(Continued)

OTHER PUBLICATIONS

J.L. Clark, McCormick & J. L. Clark presentation, Mar. 29, 2007 pp. 1-5, 7-10.

(Continued)

*Primary Examiner* — Anthony Stashick
*Assistant Examiner* — Madison L Wright
(74) *Attorney, Agent, or Firm* — Oblon, Spivak, McClelland, Maier & Neustadt, L.L.P.

(57) ABSTRACT

A multi-section lid for a can containing edible material includes a lid base, a cover portion, and a tear strip. The lid base can attach the lid to the can. The lid base defines one or more openings that permit access to the edible material. The cover portion includes one or more doors to cover the openings. The tear strip portion is positioned between the lid base and the cover portion. The tear strip portion is connected to the lid base and the cover portion by a plurality of bridges. The mold for forming the lid includes cavities that define flow channels that permit the lid material to flow through bridge cavities to fill the cavities in the mold during formation of the lid such that the lid base, the cover portion, and the tear strip portion are the single integral component.

12 Claims, 7 Drawing Sheets

U.S. PATENT DOCUMENTS

| | | | |
|---|---|---|---|
| 1,284,844 | A | 11/1918 | Wetherbee |
| 1,295,997 | A | 3/1919 | Mennen |
| 1,357,555 | A | 11/1920 | Gueritey |
| 1,464,457 | A | 8/1923 | Wendel |
| 1,599,329 | A | 9/1926 | Hinds |
| 1,658,348 | A | 2/1928 | Michael |
| 1,737,860 | A | 12/1929 | Mills |
| 1,767,781 | A | 6/1930 | Aulbach et al. |
| 1,803,799 | A | 5/1931 | Gueritey |
| 1,884,813 | A | 10/1932 | Nicholls |
| 1,890,194 | A | 12/1932 | Punte |
| 1,894,575 | A | 1/1933 | Sherman |
| 1,924,999 | A | 8/1933 | Mills |
| 1,959,874 | A | 5/1934 | Mills |
| D96,342 | S | 7/1935 | Schertz |
| 2,010,464 | A | 8/1935 | Punte |
| 2,045,855 | A | 6/1936 | Hovey |
| 2,046,929 | A | 7/1936 | Schmidt |
| 2,092,138 | A | 9/1937 | Punte |
| 2,108,045 | A | 2/1938 | Dirker |
| 2,125,497 | A | 8/1938 | Frank |
| 2,141,351 | A | 12/1938 | Forsberg et al. |
| 2,141,352 | A | 12/1938 | Forsberg et al. |
| 2,162,999 | A | 6/1939 | Frank |
| 2,167,574 | A | 7/1939 | Jones |
| 2,178,620 | A | 11/1939 | White |
| 2,183,585 | A | 12/1939 | Peters |
| 2,190,676 | A | 2/1940 | Perry |
| 2,226,899 | A | 12/1940 | Conway, Jr. |
| 2,235,987 | A | 3/1941 | Frank |
| 2,241,435 | A | 5/1941 | White |
| 2,254,581 | A | 9/1941 | Punte |
| 2,273,998 | A | 2/1942 | Rueger |
| 2,273,999 | A | 2/1942 | Rueger |
| 2,283,245 | A | 5/1942 | White |
| 2,287,747 | A | 6/1942 | Pardee |
| 2,310,271 | A | 2/1943 | Ziehmer, Jr. |
| 2,324,499 | A | 7/1943 | Erb |
| 2,327,406 | A | 8/1943 | Dukehart, Jr. |
| 2,346,847 | A | 4/1944 | Larson |
| 2,355,062 | A | 8/1944 | Erb et al. |
| 2,361,958 | A | 11/1944 | Nyden |
| D146,979 | S | 6/1947 | Mangini |
| 2,563,865 | A | 8/1951 | Pottle |
| 2,695,738 | A | 11/1954 | Gordon |
| 2,815,893 | A | 12/1957 | Frank |
| 2,878,971 | A | 3/1959 | Malachick |
| 2,957,612 | A | 10/1960 | Westgate |
| 2,961,133 | A | 11/1960 | Ankney |
| 3,127,052 | A | 3/1964 | Mayers |
| 3,129,860 | A | 4/1964 | Foster |
| 3,140,019 | A | 7/1964 | Barr |
| 3,140,804 | A | 7/1964 | Frank |
| 3,143,256 | A | 8/1964 | Lazure et al. |
| 3,155,285 | A | 11/1964 | Van Baarn |
| D200,270 | S | 2/1965 | Waterman |
| 3,169,671 | A | 2/1965 | Taylor |
| 3,187,964 | A | 6/1965 | Foster |
| 3,217,949 | A | 11/1965 | Davis |
| D204,509 | S | 4/1966 | Waterman |
| 3,251,509 | A | 5/1966 | Foster |
| 3,255,928 | A | 6/1966 | Foster |
| 3,262,606 | A | 7/1966 | Waterman |
| 3,322,308 | A | 5/1967 | Foster |
| 3,370,757 | A | 2/1968 | Foster |
| 3,397,823 | A | 8/1968 | Kirkpatrick |
| 3,469,732 | A | 9/1969 | Foster |
| 3,542,235 | A | 11/1970 | Hidding |
| 3,589,572 | A | 6/1971 | Hannon |
| 3,695,481 | A | 10/1972 | Foster et al. |
| 3,737,066 | A | 6/1973 | Ames |
| 3,759,428 | A | 9/1973 | Heter, Jr. |
| 3,773,232 | A | 11/1973 | Hidding |
| 3,817,420 | A | 6/1974 | Heisler |
| 3,872,996 | A | 3/1975 | Dogliotti |
| 3,907,156 | A | 9/1975 | Weatherhead, III |
| 4,144,985 | A | 3/1979 | Kinslow |
| 4,177,932 | A | 12/1979 | Cleevely |
| 4,253,587 | A | 3/1981 | Otterson |
| 4,280,636 | A | 7/1981 | Lewis |
| 4,349,174 | A | 9/1982 | Obrist et al. |
| 4,359,171 | A | 11/1982 | Lewis |
| 4,361,250 | A | 11/1982 | Foster |
| 4,369,901 | A | 1/1983 | Hidding |
| 4,463,869 | A | 8/1984 | Lewis |
| 4,471,881 | A | 9/1984 | Foster |
| 4,491,252 | A | 1/1985 | Schmidt et al. |
| 4,494,679 | A | 1/1985 | Cleevely |
| 4,538,731 | A | 9/1985 | Cillario |
| 4,558,806 | A | 12/1985 | Shabram, Sr. et al. |
| 4,592,480 | A | 6/1986 | Hart et al. |
| 4,610,371 | A | 9/1986 | Karkiewicz |
| 4,621,744 | A | 11/1986 | Foster |
| 4,634,019 | A | 1/1987 | Pherigo |
| 4,658,980 | A | 4/1987 | Lindstrom |
| D291,411 | S | 8/1987 | Crawford |
| 4,693,399 | A | 9/1987 | Hickman et al. |
| 4,723,693 | A | 2/1988 | DeCoster |
| 4,724,977 | A | 2/1988 | Cleevely et al. |
| 4,759,478 | A | 7/1988 | Richardson et al. |
| 4,787,530 | A | 11/1988 | Edwards |
| 4,790,448 | A | 12/1988 | Ostrum et al. |
| D301,549 | S | 6/1989 | Foster |
| 4,883,193 | A | 11/1989 | Christensson |
| D305,206 | S | 12/1989 | Hickman et al. |
| D306,830 | S | 3/1990 | DeCoster |
| 4,934,554 | A | 6/1990 | Edwards |
| 4,934,557 | A | 6/1990 | Smith |
| 4,940,191 | A | 7/1990 | Dolby |
| 4,955,513 | A | 9/1990 | Bennett |
| D312,190 | S | 11/1990 | Ciaccio |
| 4,976,369 | A | 12/1990 | Shindo et al. |
| 5,002,197 | A | 3/1991 | Ponsi |
| D318,777 | S | 8/1991 | Freese |
| 5,048,715 | A | 9/1991 | Wolff |
| 5,052,572 | A | 10/1991 | Pherigo |
| 5,085,331 | A | 2/1992 | Groya et al. |
| 5,103,989 | A | 4/1992 | Druesne et al. |
| 5,123,561 | A | 6/1992 | Gross |
| 5,145,085 | A | 9/1992 | Yost |
| D330,165 | S | 10/1992 | Brochu et al. |
| 5,195,645 | A | 3/1993 | Schuermann |
| D334,709 | S | 4/1993 | Fleming et al. |
| 5,211,301 | A | 5/1993 | Groya et al. |
| 5,219,087 | A | 6/1993 | Christensson |
| 5,219,100 | A | 6/1993 | Beck et al. |
| D339,065 | S | 9/1993 | Forsyth et al. |
| D340,187 | S | 10/1993 | Forsyth |
| 5,301,827 | A | 4/1994 | Valyi |
| 5,303,839 | A | 4/1994 | Blumenschein |
| 5,307,948 | A | 5/1994 | Blackburn et al. |
| D349,650 | S | 8/1994 | Lonczak et al. |
| 5,339,993 | A | 8/1994 | Groya et al. |
| D352,899 | S | 11/1994 | Molo |
| D353,094 | S | 12/1994 | Labrie |
| D362,595 | S | 9/1995 | Schneider |
| 5,457,843 | A | 10/1995 | Gelardi et al. |
| 5,465,871 | A | 11/1995 | Robbins, III |
| 5,482,172 | A | 1/1996 | Braddock |
| 5,552,575 | A | 9/1996 | Doumanidis |
| 5,579,932 | A | 12/1996 | Drozd et al. |
| 5,636,732 | A | 6/1997 | Gilels et al. |
| 5,657,894 | A | 8/1997 | Bowen |
| D385,791 | S | 11/1997 | Forsyth et al. |
| D386,001 | S | 11/1997 | Saffran |
| 5,695,097 | A | 12/1997 | Rollinghoff |
| 5,730,785 | A | 3/1998 | Idol et al. |
| D397,035 | S | 8/1998 | Young et al. |
| 5,810,188 | A | 9/1998 | Novakoski et al. |
| 5,897,036 | A | 4/1999 | DeCoster et al. |
| D410,388 | S | 6/1999 | Fisher et al. |
| 5,975,368 | A | 11/1999 | Wood |
| 6,068,153 | A | 5/2000 | Young et al. |
| 6,196,412 | B1 | 3/2001 | Cattell |
| D442,086 | S | 5/2001 | Mozes |
| D446,772 | S | 8/2001 | Chen et al. |
| D448,295 | S | 9/2001 | Mozes |

| | | | |
|---|---|---|---|
| D448,296 | S | 9/2001 | Bried et al. |
| D448,668 | S | 10/2001 | Baerenwald et al. |
| 6,299,033 | B1 | 10/2001 | VerWeyst et al. |
| D450,584 | S | 11/2001 | Schmit et al. |
| D450,586 | S | 11/2001 | Kick |
| 6,341,720 | B1 | 1/2002 | Schmit et al. |
| 6,355,286 | B2 | 3/2002 | Deering et al. |
| D456,713 | S | 5/2002 | Bried et al. |
| 6,422,411 | B1 | 7/2002 | Gray |
| D462,613 | S | 9/2002 | Bried et al. |
| D462,713 | S | 9/2002 | Funayama et al. |
| 6,450,393 | B1 | 9/2002 | Doumanidis et al. |
| D464,567 | S | 10/2002 | Baerenwald et al. |
| D464,886 | S | 10/2002 | Bried et al. |
| D465,732 | S | 11/2002 | Kick |
| D466,012 | S | 11/2002 | Baker |
| 6,484,929 | B2 | 11/2002 | Sumpmann et al. |
| D466,408 | S | 12/2002 | Baerenwald et al. |
| D467,801 | S | 12/2002 | Baerenwald et al. |
| D470,765 | S | 2/2003 | Baker |
| D473,792 | S | 4/2003 | Diefenbach |
| D474,402 | S | 5/2003 | Baerenwald |
| 6,561,391 | B1 | 5/2003 | Baker |
| 6,575,323 | B1 | 6/2003 | Martin et al. |
| 6,604,645 | B1 | 8/2003 | Vaupotic |
| D494,469 | S | 8/2004 | Solowiejko |
| D495,256 | S | 8/2004 | Solowiejko |
| D497,106 | S | 10/2004 | Solowiejko et al. |
| 6,821,239 | B2 | 11/2004 | Hierzer et al. |
| 6,877,631 | B1 | 4/2005 | Thompson et al. |
| 6,899,245 | B1 | 5/2005 | Nelson |
| 6,926,165 | B2 | 8/2005 | Conti |
| 6,988,642 | B2 | 1/2006 | Gallo, Jr. et al. |
| 7,021,482 | B2 | 4/2006 | Solowiejko |
| 7,063,230 | B2 | 6/2006 | Ciccone |
| 7,073,680 | B2 | 7/2006 | Boback et al. |
| 7,078,228 | B2 | 7/2006 | Lacey et al. |
| 7,114,627 | B2 | 10/2006 | Solowiejko |
| 7,118,003 | B2 | 10/2006 | Sellari et al. |
| 7,134,567 | B2 | 11/2006 | Luburic |
| D538,664 | S | 3/2007 | Solowiejko |
| D539,647 | S | 4/2007 | Solowiejko |
| 7,207,457 | B2 | 4/2007 | Schwarz |
| 7,258,255 | B2 | 8/2007 | Vogel et al. |
| 7,261,217 | B2 | 8/2007 | Solowiejko |
| D567,582 | S | 4/2008 | Blum et al. |
| 2001/0035424 | A1 | 11/2001 | Combe et al. |
| 2002/0084317 | A1 | 7/2002 | Stewart et al. |
| 2005/0040168 | A1 | 2/2005 | Solowiejko |
| 2006/0144874 | A1 | 7/2006 | Solowiejko |
| 2006/0175334 | A1 | 8/2006 | Schwarz |
| 2006/0243735 | A1 | 11/2006 | Kline et al. |
| 2006/0289541 | A1 | 12/2006 | Boback et al. |
| 2007/0000887 | A1 | 1/2007 | Caldwell et al. |
| 2007/0000953 | A1 | 1/2007 | Ranney |
| 2007/0056972 | A1 | 3/2007 | Solowiejko |
| 2007/0131639 | A1 | 6/2007 | Nakaya et al. |
| 2009/0101647 | A1 | 4/2009 | Newberry et al. |
| 2009/0101674 | A1 | 4/2009 | Newberry et al. |

FOREIGN PATENT DOCUMENTS

| | | |
|---|---|---|
| WO | WO2007/018054 | 2/2007 |

OTHER PUBLICATIONS

Office Action issued Feb. 11, 2011, in China Patent Application No. 200880112000.3 (English translation only).

Canadian Office Action issued Sep. 7, 2011, in Patent Application No. 2,702,619.

Office Action issued Aug. 30, 2011, in Chinese Patent Application No. 200880112000.3 (submitting English translation only).

Supplemental European Search Report issued Feb. 15, 2012 in European Patent Application No. 08 83 9775 filed Oct. 20, 2008.

Office Action issued Jun. 29, 2012 in China Patent Application No. 200880112000.3, filed Oct. 20, 2008 (English-language translation only).

Canadian Office Action issued Jul. 9, 2012 in Canadian Patent Application No. 2,702,619 filed Oct. 20, 2008.

TAMPER RESISTANT CONTAINER WITH LOCKING RIM

CROSS-REFERENCE TO RELATED APPLICATIONS

This application claims the benefit of priority under 35 U.S.C. §119 from U.S. Ser. No. 60/981,069, filed Oct. 18, 2007, the entire contents is herein incorporated by reference.

BACKGROUND OF THE INVENTION

1. Field of the Invention

This invention relates to tamper resistant containers for holding edible materials such as spices.

2. Description of the Related Art

In recent years there has been an increasing interest in providing food containers with tamper resistant features to ensure that the contents of the container have not been disturbed prior to opening and use by a consumer. Tear strips that must be removed in order to access the contents of the container are one well known approach to providing tamper resistance. However, conventional tear strips have often required the container top to be made from two or more separate pieces that must then be assembled. Even where container tops that include a tear strip have been formed in one piece, two or more separate mechanical operations have been required to attach the top to the container and create the tear strip. Assembling the tops to these conventional containers (such as pepper containers) has thus required multiple steps in the manufacturing process.

Another problem with conventional tear strips is that they can be difficult to remove from the container. Similarly, the tear strips sometimes do not tear off completely leaving a portion of the strip on the container thereby making it difficult to open the container doors to access the container contents.

In some conventional containers (both metal and plastic), the container top and container body are snapped or pressed together. As a result, these containers sometimes suffer from another problem because the seal between the top and the container is not perfect. The imperfect seal can allow the container contents to escape between the lid and container during use or transport. The phenomenon where the container contents escape between the lid and the container body is also known as sifting. Sifting has been observed, for example, in some conventional pepper containers when pepper escapes between the container lid and container body due to an imperfect seal between the lid and container. The seal in such conventional containers allows for easy removal of the lid and thus also does not provide a tamper evidence benefit.

Another feature of some conventional containers, particularly containers for spices such as pepper, is to have multiple doors on the container top to permit a consumer to access the container contents in different ways. For example, some pepper containers have three doors: one allowing access to the container contents with a spoon, a smaller door allowing significant quantities to be poured out of a single mid sized opening, and a third door allowing the spices to exit more slowly through a series of small holes.

SUMMARY OF THE INVENTION

Accordingly, it is an aspect of one example of the invention to provide an integral one piece container top having a tamper resistant strip that can be assembled in a minimum number of operations without requiring a separate mechanical operation to attach the tear strip to the container.

Another aspect of one example of the invention is to provide a sift-proof seal between a container top and the container body that can be easily formed.

Still another aspect of one example of the invention is to provide an improved method of attaching doors to a container top to create a hinged connection between the door and container top.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
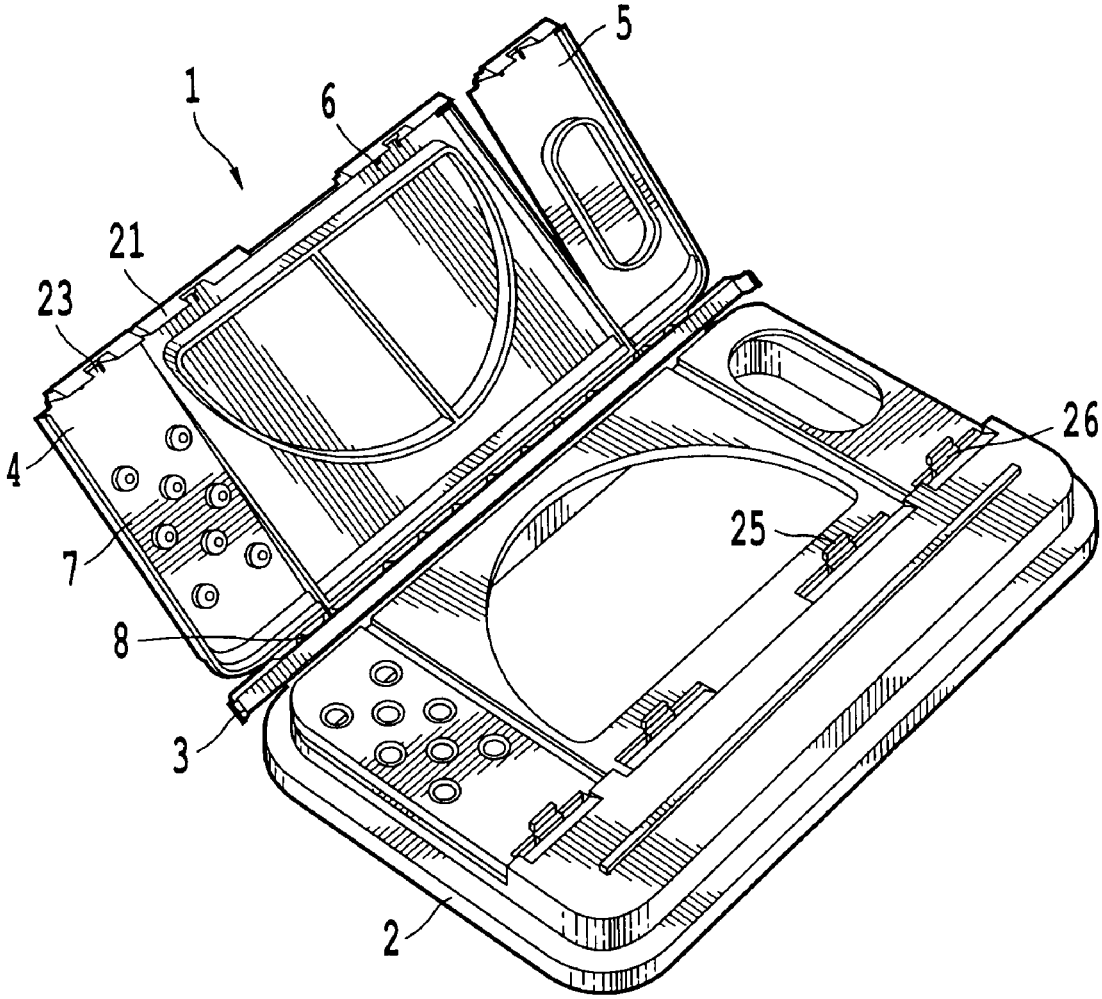
FIG. 1 is a perspective view of the integrally formed lid of an embodiment of the invention.

Referring now to the drawings, wherein like reference numerals designate identical or corresponding parts throughout the several views.

Figure 4:
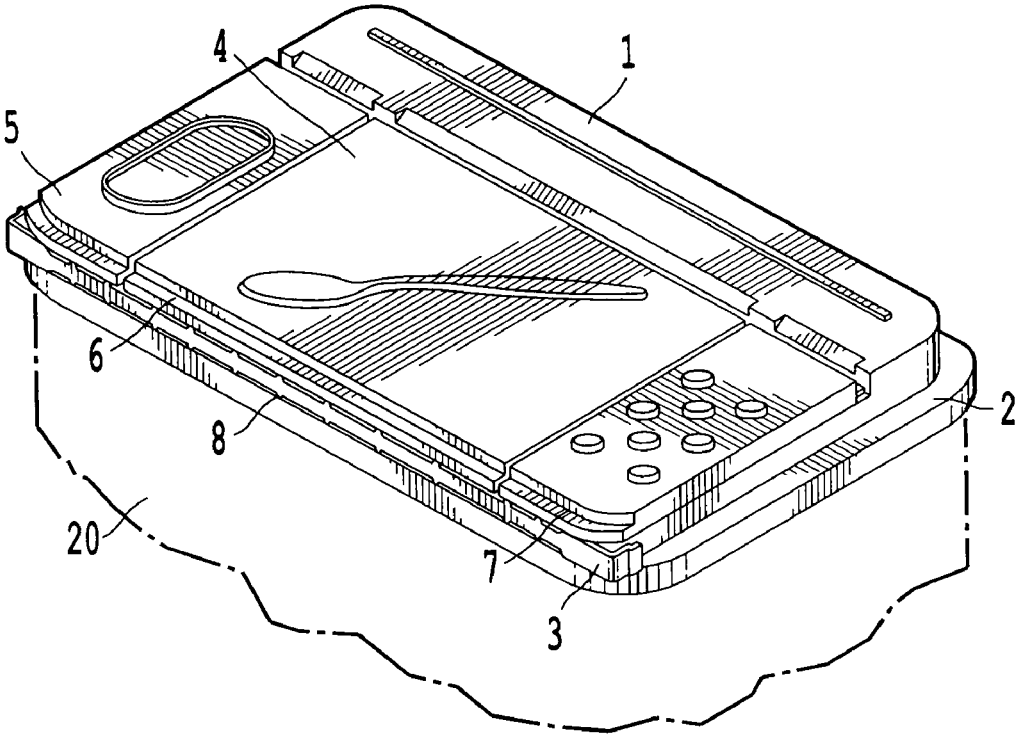
FIG. 4 is a view the top portion of a can and attached folded lid of an embodiment of the invention.

In an exemplary embodiment of the invention, a plastic lid having an integral tear strip and doors has been made to attach to a plastic can. As shown in FIG. 1, the lid 1 comprises three sections of a single integrally formed piece. These three sections include a lid base 2, a tamper resistant tear strip portion 3, and a cover portion 4. The cover portion 4 can include three separate doors 5, 6, 7. The lid base 2 can be attached to a can 20, as shown in FIG. 4.

Figure 2:
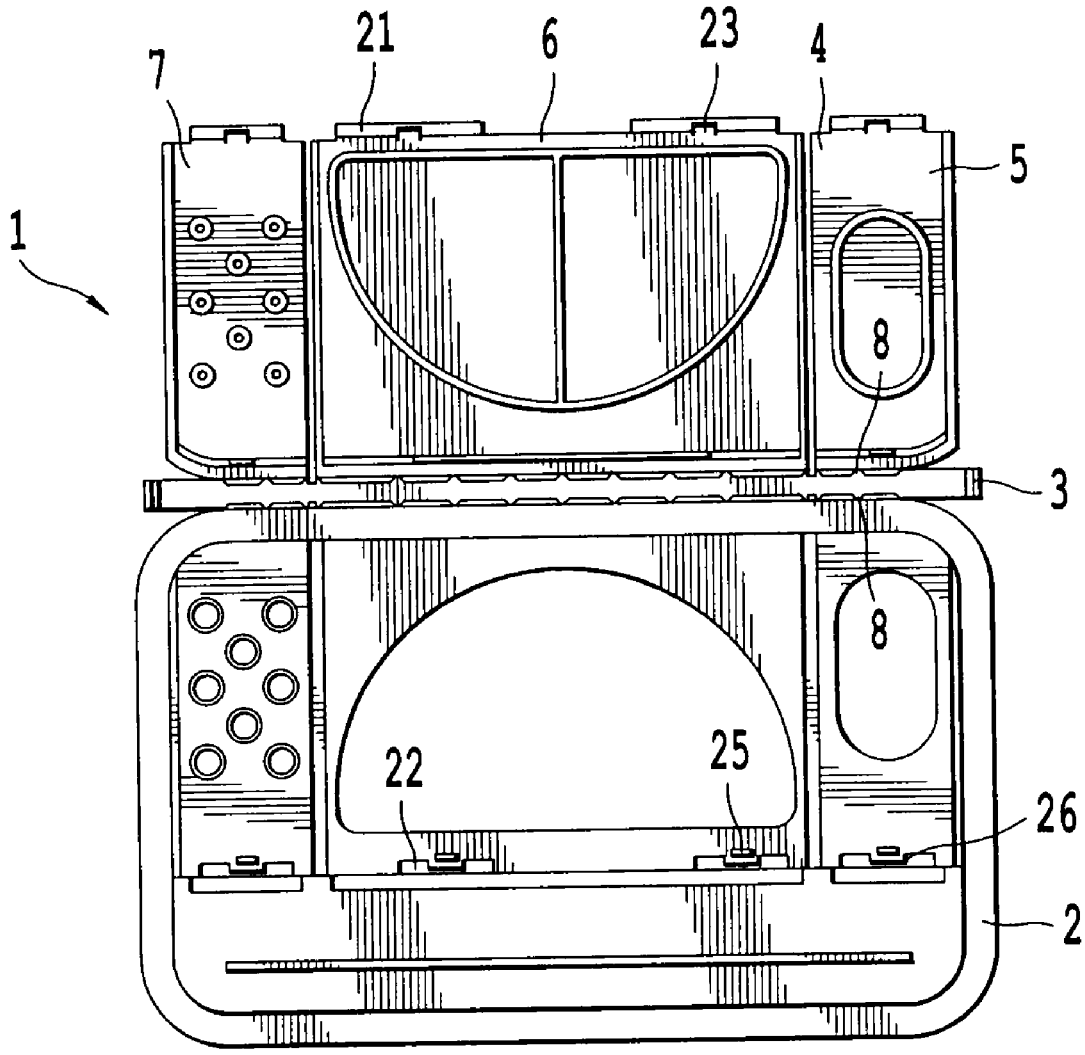
FIG. 2 is a view of a first surface of the lid of an embodiment of the invention.
Figure 3:
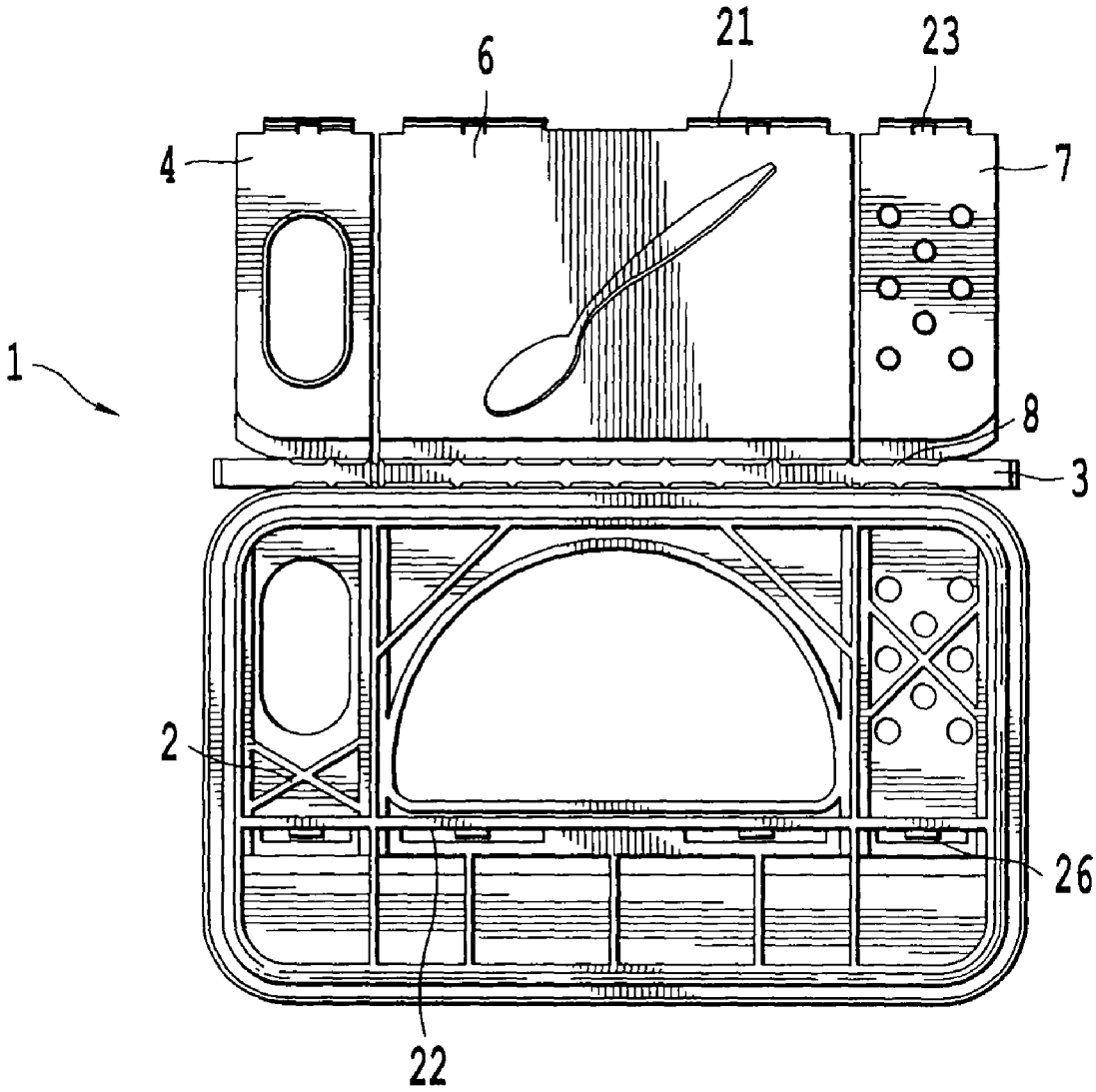
FIG. 3 is a view of a second surface of the lid of an embodiment of the invention.

The tear strip portion 3 is connected to the lid base 2 and the cover portion 4 of the lid 1 by a series of spaced apart bridges 8. See FIGS. 2 and 3. The bridges 8 may be trapazoidally shaped. In one exemplary embodiment, there are 13 bridges 8 connecting the lid base 2 and the tear strip portion 3 and 13 more bridges 8 connecting the tear strip portion 3 to the cover portion 4. As shown in FIG. 2, the bridges 8 need not all be uniformly spaced or shaped. The number, spacing, and shape of the bridges 8 has been developed so that the tear strip portion 3 is attached firmly enough to the rest of the lid 1 to perform the tamper resistant function and yet can be easily and completely removed by the user.

In addition, the bridges 8 of the tear strip portion 3 serve another important function in the formation of the one piece integral lid 1. The lid 1 is formed in a single mold, for example, by injection molding. Specifically, the lid base 2 and the cover portion 4 can be molded flat with the tear strip portion 3 creating the bridge between the two halves of the part, allowing the plastic material to flow and fill out the lid 1 with a single injection location on the main body. Thus, formation of the lid 1, plastic flows through mold channels defining the bridges from one section of the mold to the next. The dimensions of the bridges 8 have been developed so that the channels in the mold which form the bridges 8 are wide enough to permit plastic to flow between the mold sections. Accordingly, such a lid 1 can be formed by a single molding step that would previously require a much more complicated mold and molding process to produce. The bridges 8 perform still another function related to the folding of the one piece lid 1 onto the filled can 20. Specifically, the bridges 8 are of appropriate size, shape, and spacing to permit the one piece lid 1 to be folded so that the cover portion 4 can be attached to the lid base 2 to form doors such as 5, 6, and 7.

While the number of bridges 8 shown in FIG. 2 has been developed for a lid 1 having specific dimensions, it will be understood that the number of bridges 8 may be increased or decreased depending on the size of the lid 1 as appropriate. For example, a smaller container may require fewer bridges 8 while a larger container may require more bridges 8. In addition, the location and spacing of the bridges 8 may need to be adjusted depending on the container size.

Preferably, the entire lid 1 is made of plastic. One example of a material used for the lid is polypropylene. Other resins and resin blends may be used. However, polypropylene provides better functionality of the hinges (discussed below) and is better for welding (also discussed below).

Figure 5:
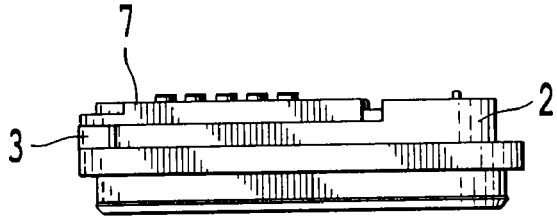
FIG. 5 is a side view of a folded lid of an embodiment of the invention.
Figure 6:
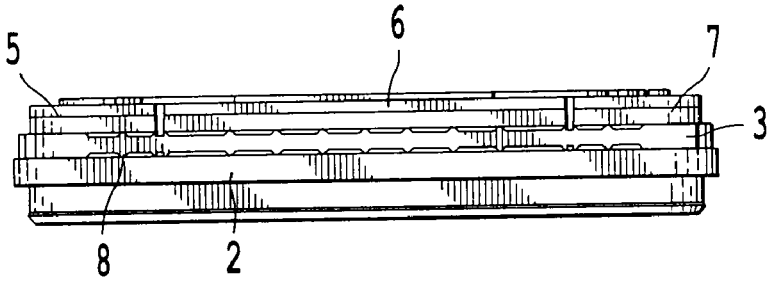
FIG. 6 is a front view of a folded lid of an embodiment of the invention.
Figure 7:
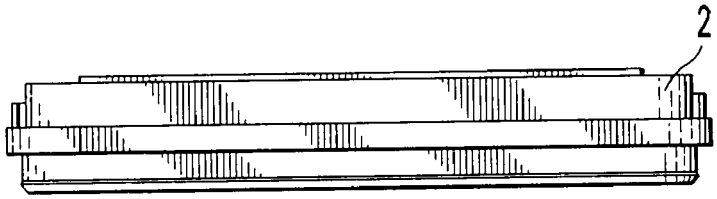
FIG. 7 is a back view of a folded lid of an embodiment of the invention.
Figure 8:
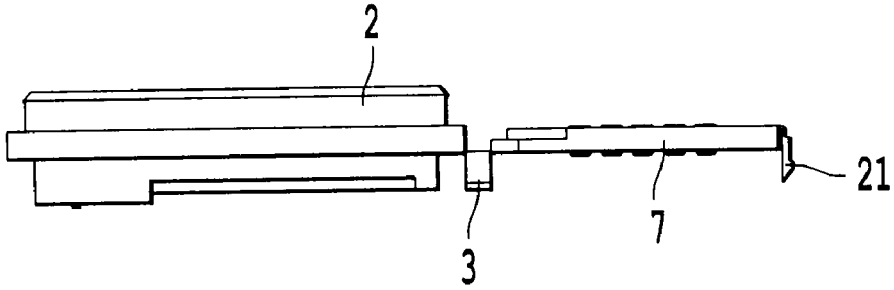
FIG. 8 is a side view of a lid of an embodiment of the invention with the doors of the lid in an open position.
Figure 9:
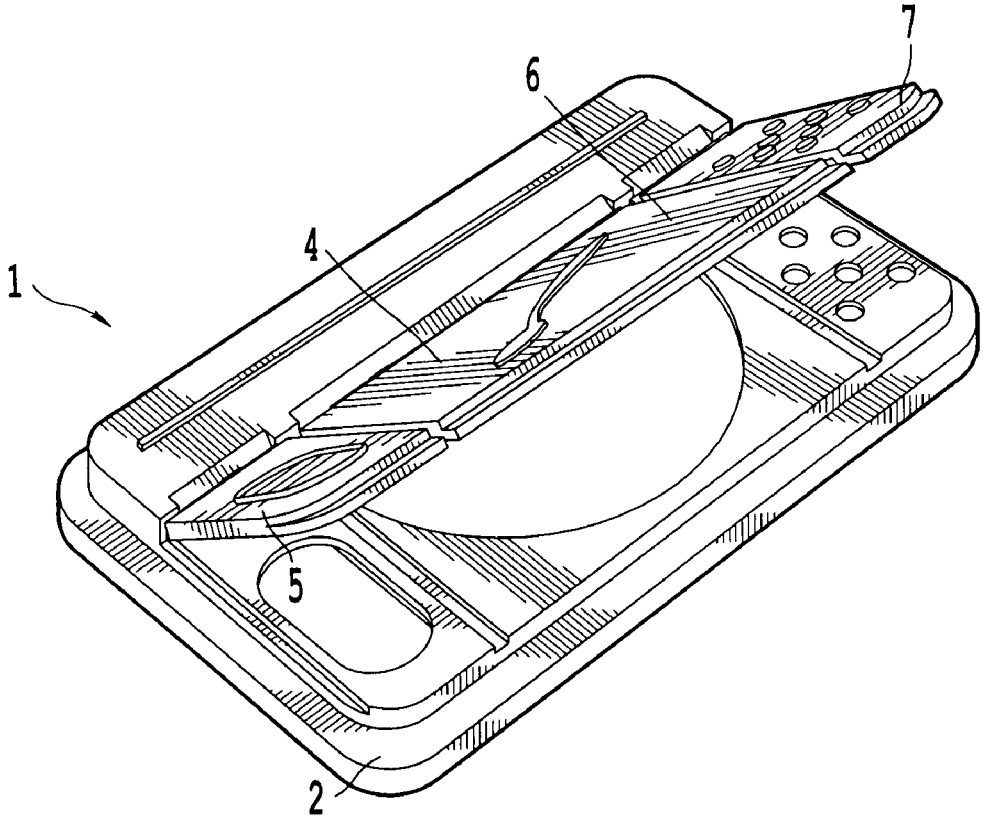
FIG. 9 is a perspective view of a folded lid of an embodiment of the invention with the doors of the lid in a partially open position.

FIG. 5 shows a side view of the lid 1 with the doors 5, 6, 7 in a folded position. FIG. 6 shows a front view of the lid 1 with the doors 5, 6, 7 in a folded position. FIG. 7 shows a back view of the lid 1 with the doors 5, 6, 7 in a folded position. FIG. 8 shows a side view of the lid 1 with the doors 5, 6, 7 in an open position. Additionally, FIG. 9 shows the lid with the doors 5, 6, 7 in a partially open position.

Figure 10:
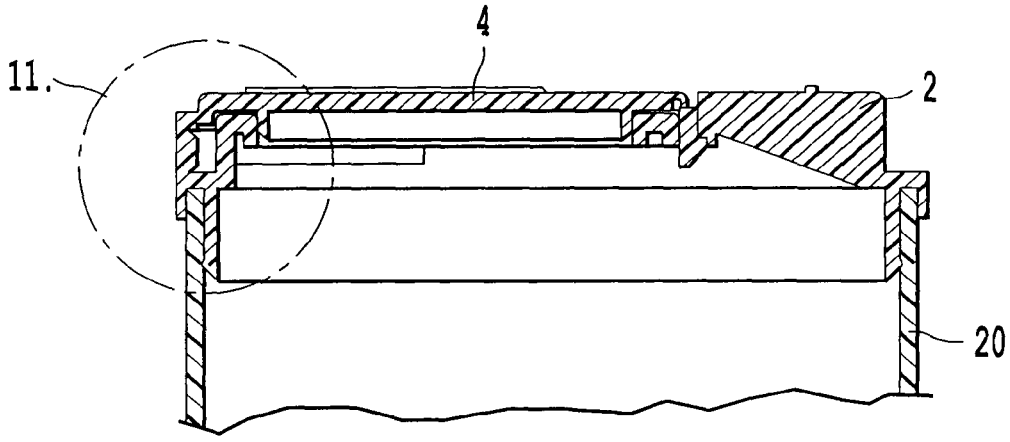
FIG. 10 is a cross section of the can and attached lid as shown in FIG. 4 of an embodiment of the invention.

A cross section of an exemplary embodiment of the lid 1 is shown in FIG. 10. In another aspect of an exemplary embodiment of the invention, the bottom of the lid base 2 and the top of the can 20 are provided with circumferential beading 12, 17, 18 during the forming of the lid base 2 and the can 20 to help form a secure connection between the lid 1 and the can 20. See FIG. 11. After being snapped together, the lid base 2 and the can 20 are sealed together, for example, by ultrasonic scan welding. During the scan welding, a sonic frequency emits vibration between the can 20 and the lid 1. The vibration then heats up the resins and melts the beads of the can 20 and the lid 1 creating a welded bond. Preferably, the scan welding is done along the beading 17 on the two long sides of the can 20.

The beading and scan welding each provide a sift-proof seal that prevents the container contents from escaping between the joint formed by the lid 1 and the can 20. The use of scan welding also provides additional tamper evidence by providing a permanent weld between the lid 1 and can 20. In other words, after scan welding the lid 1 typically cannot be removed from the can 20 without creating obvious damage to the container.

Figure 11:
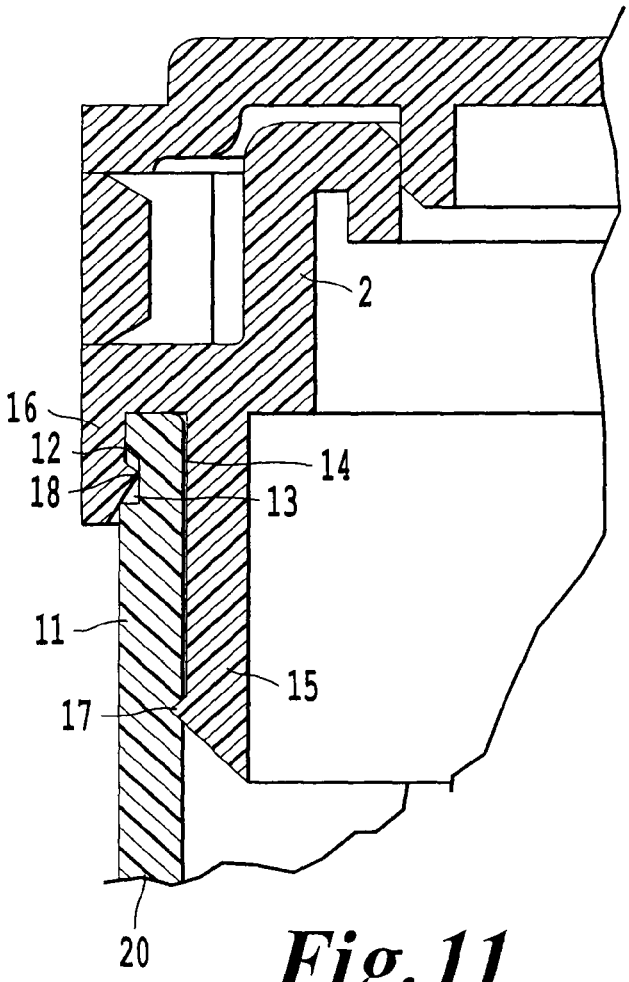
FIG. 11 is an enlarged view of a portion of the cross section of FIG. 5 of an embodiment of the invention.

More specifically, the upper portion of the can body 11 may be provided with an outer circumferential bead 12 and outer circumferential groove 13 as shown in FIG. 11. The topmost portion of the inner wall 14 of the can body 11 may have a small step (not shown). At the same time, the bottom side of the lid base 2 has an inner skirt 15 and outer skirt 16. Near the end of the inner skirt 15 is a bead 17 that faces the inner wall 14. The end of the inner skirt 15 is also formed at an angle, preferably 45 degrees, to facilitate attachment of the lid 1 onto the can 20. The outer skirt 16 of lid base 2 also has a bead 18 designed to mate with the outer circumferential groove 13 of the can 20. The circumferential can and lid beading and groove allow the lid 1 to be snapped onto the can 20 so that the lid base 2 and the can 20 engage each other as shown in FIG. 11.

The scan welding is a continuous process in which the can 20 with the lid 1 thereon can move along an assembly line and wipe the horn which produces the ultrasonic vibration. In comparison, in a sonic welding process such as spot welding, the package needs to stop for the horn to come in contact with the part to be welded. Thus, the scan welding allows for faster line speeds and less equipment, resulting in higher productivity and lower cost.

Another aspect of an exemplary embodiment relates to the structure utilized to create the hinges that attach the doors 5, 6, 7 to the lid base 2. As can be seen in FIG. 2, the doors 5, 6, 7 may be provided with plugs 21 that are inserted into slots 22 in the lid base 2. When the lid 1 is folded at the tear strip 3 to connect the cover portion 4 to the lid base 2, the plugs 21 are inserted into the slots 22. After the plugs 21 are inserted into the slots 22, a ledge on the end portion of the plugs 21 abuts against a bottom surface of the slots 22 such that the plugs 21 can remain positioned within the slots. Thus, the inserted plugs 21 form door hinges and facilitate opening and closing of the doors 5, 6, 7. The slots 22 may also include base plugs 26 therein to prevent sifting due to a gap between the plugs 21 and the slots 22. In addition, a locking finger 23 may be added to the door plugs 21. See FIG. 2. The locking finger 23 may be molded into the back side of the door hinge and is not inserted into the slots 22 of the lid base 2. In addition, pedestals 25 may be added to the lid base 2 to contact the locking finger 23. Upon opening of the doors, the locking fingers 23 of the door plugs 21 and the pedestals 25 interact to help keep the doors open during use of the container.

Although the description above contains many specifics, these should not be construed as limiting the scope of the invention but as merely providing illustrations of some of the presently preferred embodiments of this invention. Thus the scope of the invention should be determined by the appended claims and their legal equivalents, rather than by the examples given.

Obviously, numerous modifications and variations of the present invention are possible in light of the above teachings. It is therefore to be understood that within the scope of the appended claims, the invention may be practiced otherwise than as specifically described herein.

The invention claimed is:

1. A multi-section lid for a can containing edible material, comprising:

a lid base to attach the lid to the can, the lid base defining one or more openings where said openings permit access to the edible material;

a cover portion comprising one or more doors to cover said openings; and a tear strip portion positioned between said lid base and said cover portion, wherein a bottom edge of said tear strip portion is connected to the lid base by a first plurality of bridges and a top edge of the tear strip portion is connected to the cover portion by a second plurality of bridges, wherein said lid base, cover portion, and tear strip portion are a single integral component with the tear strip portion positioned between the lid base and the cover portion such that the first plurality of bridges is molded between the bottom edge of said tear strip portion and the lid base and the second plurality of bridges is molded between the top edge of said tear strip portion and the cover portion.

2. The lid according to claim 1, wherein two or more of said bridges are trapezoidally shaped.

3. The lid according to claim 1, further comprising:

plug portions integrally formed on an end of each door, wherein said lid base defines slots to receive each door plug portion, and said plug portions form door hinges when inserted into said slots.

4. The lid according to claim 3, further comprising:

a locking finger positioned on a back side of each of the door hinges and facing downward into the slots when each of the door is in a closed position, wherein the locking finger is configured to contact the respective door hinge when the door is in an open position to prevent the door from closing.

5. The lid according to claim 3, wherein the slots each include a base plug configured to prevent sifting of the edible material through the slots when the cover portion is in a folded position.

6. The lid according to claim 2, further comprising:

plug portions integrally formed on an end of each door, wherein said lid base defines slots to receive each door plug portion, and said plug portions form door hinges when inserted into said slots.

7. The lid according to claim 6, further comprising:

a locking finger positioned on a back side of each of the door hinges and facing downward into the slots when each of the door is in a closed position, wherein the locking finger is configured to contact the respective door hinge when the door is in an open position to prevent the door from closing.

8. The lid according to claim 6, wherein the slots each include a base plug configured to prevent sifting of the edible material through the slots when the cover portion is in a folded position.

9. The lid according to claim 1, wherein the lid base, the cover portion, and the tear strip portion are formed together as the single integral component.

10. A multi-section lid for a can containing edible material, comprising:

a lid base to attach the lid to the can, the lid base defining one or more openings where said openings permit access to the edible material;

a cover portion comprising one or more doors to cover said openings;

a tear strip portion is positioned between said lid base and said cover portion, and said tear strip portion is connected to the lid base and the cover portion by a plurality of bridges;

plug portions integrally formed on an end of each door, said lid base defines slots to receive each plug portion, and said plug portions form door hinges when inserted into said slots; and a locking finger positioned on a back side of each of the door hinges and facing downward into the slots when each of the door is in a closed position, and the locking finger is configured to contact the respective door hinge when the door is in an open position to prevent the door from closing, wherein said lid base, cover portion, and tear strip portion are a single integral component.

11. The lid according to claim 10, wherein two or more of said bridges are trapezoidally shaped.

12. The lid according to claim 10, wherein the slots each include a base plug configured to prevent sifting of the edible material through the slots when the cover portion is in a folded position.

* * * * *